United States Patent [19]

Kapolas et al.

[11] Patent Number: 4,533,059

[45] Date of Patent: Aug. 6, 1985

[54] VACUUM-TAMPER INDICATING BUTTON FOR SMALLER DIAMETER CAPS AND THE LIKE

[75] Inventors: William J. Kapolas, Mt. Prospect; Peter A. Vercillo, Hinsdale; Daniel Dowling; George S. Beatovic, both of Chicago; Oscar N. Clifton, Schaumburg; Ronald Gatz, Park Ridge; Eugene W. Harford, Chicago; Chester Wilczenski, Lombard; John Dobbs, Des Plaines; Ronald Kowalczyk, Chicago; Derek G. Owen, Bensenville; John N. Banich, Chicago, all of Ill.

[73] Assignee: Continental White Cap, Inc., Northbrook, Ill.

[21] Appl. No.: 620,304

[22] Filed: Jun. 13, 1984

[51] Int. Cl.[3] ..... G01L 19/12

[52] U.S. Cl. ..... 215/230; 215/262; 215/271; 215/276

[58] Field of Search ..... 215/230, 260, 262, 271, 215/276, 354, 365

[56] References Cited

U.S. PATENT DOCUMENTS

| | | | |
|---|---|---|---|
| 2,194,004 | 3/1940 | Bukolt | 215/271 |
| 3,061,132 | 10/1962 | Geddes | 215/262 |
| 3,062,396 | 11/1962 | Foss et al. | 215/271 |
| 3,152,711 | 10/1964 | Mumford et al. | 215/271 |
| 3,369,689 | 2/1968 | Dodge | 215/262 |
| 3,836,033 | 9/1974 | Podesta | 215/276 X |
| 3,967,746 | 7/1976 | Botkin | 215/271 X |

*Primary Examiner*—Steven M. Pollard

*Attorney, Agent, or Firm*—Charles E. Brown

[57] ABSTRACT

This relates to a closure cap for containers wherein the end wall of the closure cap and more particularly an end panel thereof may be subjected to a vacuum which will determine the condition within the container. The closure cap involved is of a small diameter and is specifically intended for use in conjunction with neck finishes having diameters ranging from 27 mm to 43 mm. The end panel of the closure cap is of a specific configuration so that a small diameter central portion in the form of a button will evert under the existing vacuum conditions so as to present a substantially plain end panel when the vacuum condition exists within the container and which will show a popped up button when the vacuum has been relieved. The button will be indicative of product condition or possible tampering.

17 Claims, 4 Drawing Figures

VACUUM-TAMPER INDICATING BUTTON FOR SMALLER DIAMETER CAPS AND THE LIKE

This invention relates in general to new and useful improvements in closure caps, and more particularly to small diameter closure caps having a vacuum-tamper indicating button.

It has been known to provide closure caps with a button configuration which appears when the closure cap is initially formed, but essentially disappears when the closure cap is applied to a container in which a vacuum condition exists. Typical of such closure caps are those which are utilized on baby food jars to indicate the loss of a vacuum. When the vacuum is lost, although the closure cap remains securely on the container, the button disappears.

In the past, buttons have been effectively incorporated in larger diameter closure caps, i.e. closure caps for containers having a neck finish with a diameter on the order of 55 mm and larger. However, when the same type of button configuration was attempted on a smaller scale, i.e. with respect to closure caps suitable for use with neck finishes having a diameter below 44 mm, satisfactory performance could not be obtained.

In accordance with this invention, there is proposed an end panel with a button configuration which is suitable for closure caps for use with neck finish diameters as low as 27 mm and up to 43 mm. Above 43 mm, the prior art button configuration will perform satisfactorily.

It is to be understood that the available space for the tamper or vacuum indicating button is reduced not only by the small size of the closure cap, but also the need at the end of the closure cap for a channel for receiving therein the gasket material or sealant.

In accordance with this invention, it has been found that with respect to very small diameter available end panels, for example with respect to a closure cap for a 30 mm neck finish, the available diameter will be on the order of 0.750 to 0.820", whereas the cap diameter at the outside will be generally on the order of 1.319 to 1.325". Thus, it will be seen that the available area is on the order of only 60% of the cap exterior diameter.

It has been found, in accordance with this invention, that if the end panel within the channel for the gasket material has a slight rise and then a lesser dip, followed by a very lightly domed central portion, when the normal vacuum is pulled in a container the domed central portion which appears as the button will evert with a resultant decrease in the rise together with generally a decrease in the dip, and the everted central portion forming a general continuation of the dip so that the end panel has a generally flat appearance which is readily distinguishable from the protruding button appearance.

With the above and other objects in view that will hereinafter appear, the nature of the invention will be more clearly understood by reference to the following detailed description, the appended claims, and the several views illustrated in the accompanying drawings:

IN THE DRAWINGS

Figure 1:
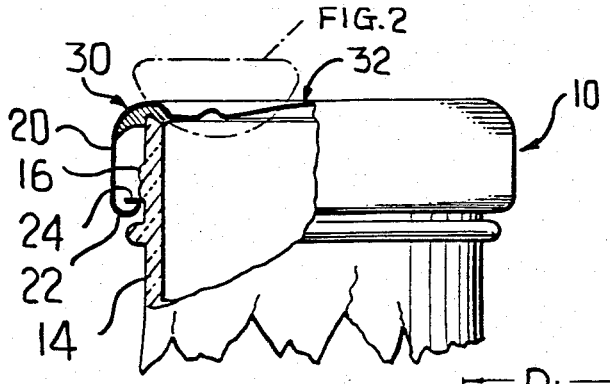
FIG. 1 is an elevational view of a closure cap formed in accordance with this invention with parts broken away and shown attached to a container neck finish.

Referring now to the drawings in detail, reference is first made to FIG. 1 wherein there is illustrated a closure cap which is the subject of this invention and is identified by the numeral 10. The closure cap 10 is illustrated as being applied to a neck finish, generally identified by the numeral 12, of a container 14. The shape of the container 14 below the neck finish 12 is immaterial as far as this invention is concerned.

It is to be understood that the closure cap 10 may either be of the screw-on type or the press-on type and the neck finish 12 will be of a shape in accordance with the closure cap. In the illustrated embodiment of the invention, the closure cap 10 is of the screw-on or twist-on type and the neck finish 12 will include a plurality of partial threads 16 of which a portion of one thread only is shown. The neck finish 12 will also have a free end 18 which functions as a sealing end.

As is customary, the closure cap 10 is formed of sheet metal and includes a skirt 20 having an inturned lower portion 22 terminating generally in a reversed curl 24 which, in the case of a twist-on closure, will be further shaped to define a plurality of lugs which cooperate with the partial threads 16 as shown.

The skirt 20 terminates at its upper edge in a downwardly opening channel 26 in which there is positioned suitable gasket material or sealant 27 which is formable over the free end 18 of the neck finish 12 to form a seal with the neck finish. The radially inner part of the channel 26 is in the form of a downwardly and radially inwardly sloping portion 28.

It is to be understood that the channel 26 forms a radially outer part of an end wall, generally indicated by the numeral 30, of the closure cap 10. It is also to be understood that, for the purpose of describing the invention, that part of the end wall 30 radially within the channel 26 will be described as an end panel 32 and that this end panel 32 will be axially recessed with respect to the projecting channel 26.

Figure 3:
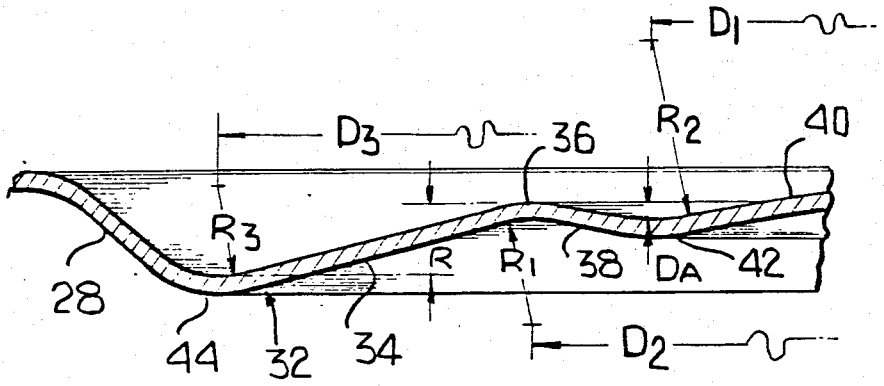
FIG. 3 is an enlarged fragmentary sectional view similar to FIG. 2, but showing a preferred relationship of various portions of the end wall.

In FIG. 3, there is specifically illustrated a button configuration suitable for the limited area of the end panel 32 when the closure cap 10 is of a size to fit a 30 mm neck finish. The end panel 32 includes a radially outer annular flange 34 which slopes axially outwardly and radially inwardly and has a rise R. Radially inwardly of the flange 34 and connected to the flange 34 by an arcuate cross-sectional part 36 having a radius R1 is an intermediate annular flange 38. The flange 38 slopes radially inwardly and axially inwardly to have a dip D.

Within the flange 38 there is a central portion 40 which is slightly upwardly domed and is connected to the flange by an arcuate cross-sectional portion 42 having a radius R2.

In the embodiment of FIG. 3, the outer flange 34 is connected to the portion 28 of the channel 26 by an arcuate cross-sectional portion 44 having a radius R3.

Figure 2:
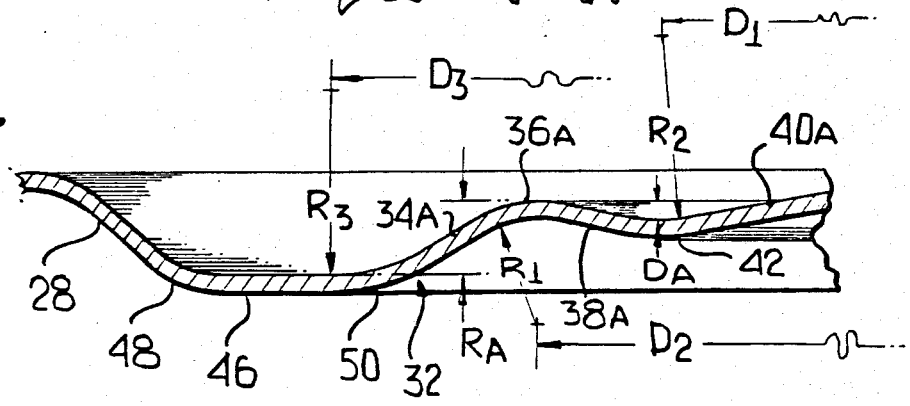
FIG. 2 is an enlarged fragmentary sectional view of the encircled area FIG. 2 of FIG. 1, and shows specifically the cross section of the end wall of a closure cap embodying the invention.

Referring now to FIG. 2 in particular, it will be seen that there is illustrated a slightly different configuration of the end panel 32. The end panel 32 will have an outer annular flange 34A to which there is joined an intermediate flange 38A by way cf an arcuate cross-sectional portion 36A. Further, there will be a slightly domed central portion 40A which is connected to the intermediate flange 38A by an arcuate cross-sectional portion 42A. The flange 34A will have a rise $R_A$ while the intermediate flange 38A will have a dip $D_A$. Further, in lieu of the flange 34A being directly connected to the portion 28 of the channel 26, there may be an annular panel 46 which is joined to the portion 28 by an arcuate portion 48 and to the flange 34A by an arcuate portion 50. At this time it is pointed out that in the formation of a closure cap there will be a number of variants due to spring-back, etc. following the formation. Therefore, the end panel of the closure cap 10 may vary from the preferred configuration of FIG. 3 to a possible configuration as shown in FIG. 2 basically utilizing the same tooling. Accordingly, hereinafter there will be given specific dimensions for a closure cap having a 30 mm neck finish which will be exemplary of dimensions which closure caps for container neck finishes ranging from 27 mm to 43 mm.

Figure 4:
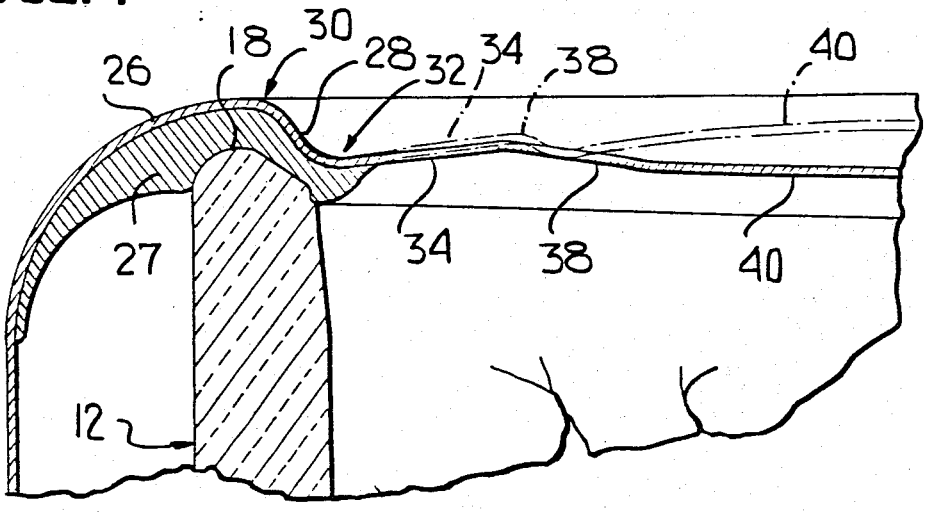
FIG. 4 is an enlarged diagrammatic view showing the appearance of the button area as formed with the button up and as applied under vacuum conditions with the button down.

With particular reference to the diagrammatic showing of FIG. 4, it will be seen that when the closure cap 10 is not effected by a vacuum environment, the outer flange 34 will have the rise R and the intermediate flange 38 will have the dip. Further, the central portion 40 will have its slightly domed appearance. At this time it is pointed out that the central portion 40 does not project above the top of the channel 26.

When the closure cap 10 is properly applied to a container under vacuum conditions, the central portion 40 will evert with the rise of the outer flange 34 slightly decreasing and with the intermediate flange 38 slightly dipping into the container, but not necessarily at the same degree of dip as originally provided. Further, the central portion 40 will have a radially outer part thereof forming a gentle continuation of the dip of the intermediate flange 38 and assuming a very slightly dished but substantially planar state.

The end panel 32, when the button is down, has the general appearance of being planar while, when the button is up, the button has a pronounced appearance and is easily visually ascertainable so that one inspecting a product to be purchased will be immediately informed that the vacuum condition no longer exists within the container.

At this time it is pointed out that buttons have been utilized in the past with respect to closure caps primarily to indicate the possibility of spoilage of the packaged product. However, such buttons may be utilized in conjunction with products which are not readily subject to spoilage for the purpose of indicating that someone may have sufficiently removed the closure cap to relieve the vacuum in the container and thus give rise to evidence of tampering. Therefore, the closure cap 10 may be alternatively utilized to indicate product spoilage or possible tampering, or both.

Closure caps of the sizes indicated above will normally be formed from double reduced steel sheet having a yield stress above 82,000 p.s.i. with the sheet metal having a base weight varying from 50 pounds to 65 pounds which is equivalent of thicknesses of 0.0055 to 0.0072".

In order more particularly to identify the relative sizes of the different portions of the end panel 32, with particular reference to FIG. 3, it will be seen that the central portion will be of a diameter D1, the outer diameter of the intermediate flange 38 will be identified as a diameter D2, and the outer diameter of the outer flange 34 will be identified as a diameter D3.

When a preferred cap is formed for a 30 mm neck finish, the dimensions of the closure cap in inches will be as follows:

Cap outside diameter—1.321
D3: 0.792; R3; 0.034
D2: 0.642; R1: 0.057
D1: 0.598; R2: 0.034
Width of annular panel: 0.000
Rise: 0.012; Dip: 0.003
End Panel Thickness: 0.0061 (55# DR-9 Plate)

In regard to ranges of dimensions which could occur in the same cap (due to springback differences, different button heights and panel depths and concentricity differences) for the same closure cap the range of dimensions may be in inches:

Cap outside diameter: 1.319 to 1.325
D3: 0.750 to 0.820; R3: 0.025 to 0.045
D2:.0.611 to 0.651; R1: 0.020 to 0.075
D1: 0.555 to 0.595; R2: 0.015 to 0.075
Width of annular panel: 0.000 to 0.040
Rise: 0.004 to 0.015; Dip: 0.000 to 0.005
End panel thickness: 0.0055 to 0.0067

It is to be understood that as the diameter of the neck finish for which the closure cap is intended increases, the dimensions may be proportionally increased or the width of the annular panel 46 may be increased.

Although only a preferred embodiment of the closure cap has been specifically illustrated and described herein, it is to be understood that minor variations may be made in the closure cap dimensions without departing from the spirit and scope of the invention as defined by the appended claims.

We claim:

1. A closure cap for vacuum packed containers, said closure cap being in the form of a sheet metal shell configurated to include an outer skirt having at an upper edge thereof a downwardly opening channel for receiving a sealant, and an end panel recessed within said channel, said end panel being primarily in the form of a vacuum actuated tamper indicating button, said button including a radially outer upwardly sloping annular flange having a rise, an intermediate downwardly sloping annular flange having a dip and joined to said outer flange by a first radius, and an upwardly sloping central portion joined to said intermediate flange by a second radius, said central panel being movable downwardly under influence of a vacuum on said end panel to have a downward slope.

2. A closure cap according to claim 1 wherein said central panel when downwardly sloping under the influence of a vacuum forming a general continuation of said intermediate panel.

3. A closure cap according to claim 1 wherein said central panel when downwardly sloping under the influence of a vacuum forming a general continuation of said intermediate panel with a resultant decrease in both said rise and said dip.

4. A closure cap in accordance with claim 1 wherein said rise exceeds said dip.

5. A closure cap in accordance with claim 1 wherein said rise exceeds said dip on the order of 3 to 4 times said dip.

6. A closure cap according to claim 1 wherein said outer upwardly sloping flange has an outer periphery directly connected to said channel by a third radius.

7. A closure cap according to claim 1 wherein said outer upwardly sloping flange has an outer periphery connected to said channel by an annular panel.

8. A closure cap according to claim 1 wherein said end panel has a thickness on the order of 0.0055 to 0.0072 inch base thickness.

9. A closure cap according to claim 1 wherein said central portion has a rise such that said central portion is recessed relative to said channel.

10. A closure cap according to claim 1 wherein said central portion has a diameter on the order of 75% of the diameter of said end panel.

11. A closure cap according to claim 1 wherein said intermediate flange has a width on the order of 3% of the diameter of said end panel.

12. A closure cap according to claim 1 wherein said outer flange has a width on the order of 10% of the diameter of said end panel.

13. A closure cap according to claim 1 wherein said central portion has a diameter on the order of 75% of the diameter of said end panel, said intermediate flange has a width on the order of 3% of the diameter of said end panel, and said outer flange has a width on the order of 10% of the diameter of said end panel.

14. A closure cap according to claim 1 wherein said central portion primarily forms said button.

15. A closure cap according to claim 1 wherein said closure cap is of a size ranging from 27 mm to 43 mm.

16. A closure cap according to claim 1 wherein said closure cap is of a size on the order of 30 mm.

17. A closure cap according to claim 1 wherein said closure cap is of a size as small as 27 mm.

* * * * *